US006199775B1

(12) United States Patent
Dallmeyer

(10) Patent No.: US 6,199,775 B1
(45) Date of Patent: Mar. 13, 2001

(54) FUEL INJECTOR FILTER UNIT HAVING A COMPOSITE HOUSING

(75) Inventor: Michael P. Dallmeyer, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/511,273

(22) Filed: Feb. 23, 2000

(51) Int. Cl.[7] ..... B05B 1/30

(52) U.S. Cl. ..... 239/575; 239/DIG. 23; 239/585.1; 239/533.2; 239/590; 210/232; 210/445; 137/549; 123/470

(58) Field of Search ..... 239/575, DIG. 23, 239/590, 590.3, 585.1–585.5, 533.2–533.12, 88–92; 210/232, 445; 137/549; 123/470

(56) References Cited

U.S. PATENT DOCUMENTS

| | | | | |
|---|---|---|---|---|
| 4,946,107 | | 8/1990 | Hunt | 239/585 |
| 5,335,863 | * | 8/1994 | DeGrace | 239/DIG. 23 |
| 5,340,032 | * | 8/1994 | Stegmaier et al. | 239/585.1 |
| 5,356,079 | | 10/1994 | Rahbar | 239/585.1 |
| 5,516,424 | | 5/1996 | Strohschein | 210/232 |
| 5,641,126 | * | 6/1997 | Nally et al. | 239/590.3 |
| 5,704,553 | | 1/1998 | Wieczorek et al. | 239/585.1 |
| 5,915,626 | | 6/1999 | Awarzamani et al. | 239/135 |
| 5,927,613 | | 7/1999 | Koyanagi et al. | 239/585.1 |
| 6,019,128 | * | 2/2000 | Reiter | 239/DIG. 23 |
| 6,135,094 | * | 10/2000 | Okada et al. | 123/470 |

FOREIGN PATENT DOCUMENTS

| | | |
|---|---|---|
| 2 225 383 | 5/1990 | (GB) . |
| WO 94/25748 | 11/1994 | (WO) . |

* cited by examiner

*Primary Examiner*—Patrick Brinson
*Assistant Examiner*—Dinh Q Nguyen

(57) ABSTRACT

A filter unit for an inlet tube of a fuel injector is shown. The inlet tube has an inside surface, an outside surface, and an annular end surface extending between the inside and outside surfaces. The filter unit includes a filter mesh defining a flow area. A body directs fuel flow through the flow area. The body has a first portion adapted for overlying the inside surface, a second portion adapted for overlying the annular end surface, and a third portion adapted for overlying the outside surface. A ferrule reinforces the body. The ferrule has a first part contiguously engaging the first portion of the body, a second part contiguously engaging the second portion of the body, and a third part contiguously engaging the third portion of the body.

16 Claims, 1 Drawing Sheet

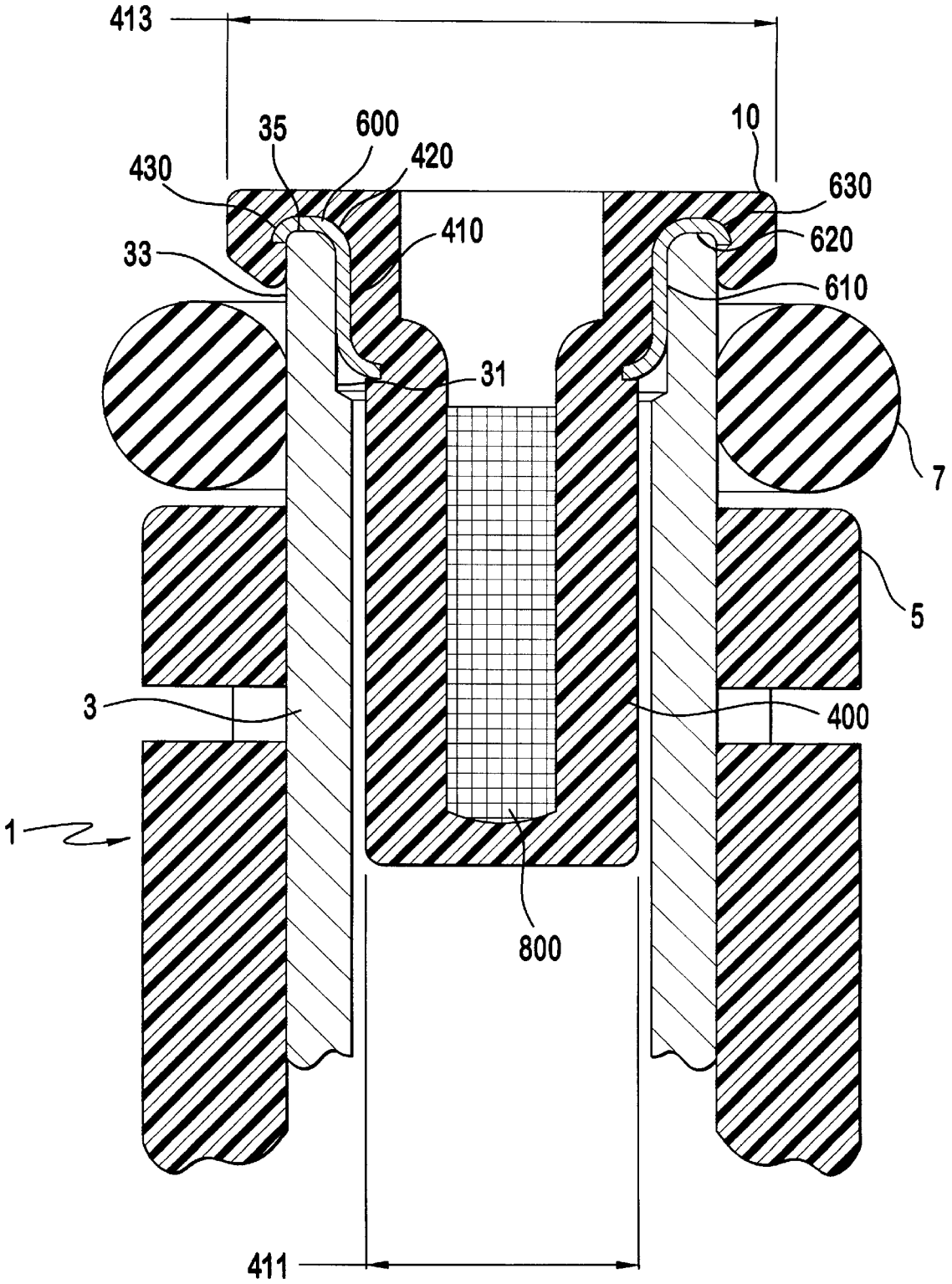
413
35
600
10
430
420
630
410
620
33
610
31
7
5
3
400
1
800
411

FUEL INJECTOR FILTER UNIT HAVING A COMPOSITE HOUSING

BACKGROUND OF THE INVENTION

The present invention relates to a filter, and more particularly a fuel injector filter having a composite housing including a plastic body that is reinforced with a metal ferrule. The fuel filter also provides a retaining feature preventing axial dislocation of an O-ring surrounding the fuel injector and sealingly connecting the fuel injector to a fuel supply.

It is known to use a fuel filter to remove particulate matter and impurities from a fuel used in a conventional fuel injector assembly. The use of a fuel filter is believed to increase the efficiency of an engine using the fuel injector assembly, as well as to decrease the production of undesired exhaust. These fuel filters are often attached to an inlet tube of the fuel injector assembly by a manufacturing process known as "staking." The fuel filter must be precisely aligned before attachment to the fuel injector assembly. Thus, the manufacturing process of the fuel injector assembly is laborious and expensive. Further, the attached fuel filter may not be easily removed from the fuel filter assembly.

For these reasons, it is desired to have a fuel filter which may be easily installed and removed from a fuel injector assembly.

SUMMARY OF THE INVENTION

The present invention provides a filter unit for an inlet tube of a fuel injector. The inlet tube has an inside surface, an outside surface, and an annular end surface extending between the inside and outside surfaces. The filter unit includes a filter mesh defining a flow area. A body directs fuel flow through the flow area. The body has a first portion adapted for overlying the inside surface, a second portion adapted for overlying the annular end surface, and a third portion adapted for overlying the outside surface. A ferrule reinforces the body. The ferrule has a first part contiguously engaging the first portion of the body, a second part contiguously engaging the second portion of the body, and a third part contiguously engaging the third portion of the body.

The present invention further provides a fuel injector including an inlet tube having an inside surface, an outside surface, and an annular end surface extending between the inside and outside surfaces. A filter unit includes a filter mesh defining a flow area. A body directs fuel flow through the flow area. The body has a first portion overlying the inside surface, a second portion overlying the annular end surface, and a third portion overlying the outside surface. A ferrule reinforces the body. The ferrule has a first part contiguously engaging the first portion of the body, a second part contiguously engaging the second portion of the body, and a third part contiguously engaging the third portion of the body.

The present invention also provides a method of manufacturing a filter unit for an inlet tube of a fuel injector. A filter mesh defining a flow area is provided. A ferrule having a first part adapted for overlying the inside surface, a second part adapted for overlying the annular end surface, and a third part adapted for overlying the outside surface is provided. A body to connect the filter mesh and the ferrule is molded, the body directing the fuel flow through the flow area.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

The FIGURE is a cross-sectional view showing an upper end of a fuel injector and a filter according to the present invention.

DETAILED DESCRIPTION OF THE PREFERRED EMBODIMENTS

The FIGURE is a cross-sectional view showing a fuel injector 1 comprising an inlet tube 3 encircled by an overmold 5. An O-ring 7 sealingly connects the fuel injector 1 to a fuel supply such as a fuel rail (not shown). A fuel filter unit 10 according to the present invention is shown disposed within a fuel injector inlet tube 3. The fuel injector inlet tube 3 includes an inside surface 31, an outside surface 33, and an annular end surface 35 extending between the inside and outside surfaces 31, 33, respectively. The fuel injector inlet tube 3 may be disposed within a variety of conventional fuel injector assemblies, including top feed fuel injectors and bottom feed fuel injectors, for example.

The fuel filter unit 10 includes a filter body 400, a ferrule 600, and a filter mesh 800. The filter mesh 800 defines a flow area through the fuel filter unit 10. The filter mesh 800 may be constructed from a variety of materials, including metals such as stainless steel and plastics or the like, having filter mesh orifices of a variety of sizes. Preferably, the filter mesh 800 is 40 $\mu$m nylon mesh.

The filter body 400 has a first portion 410, a second portion 420, and a third portion 430. The first portion 410 is adapted for overlying the inside surface 31 of the fuel injector inlet tube 3. The first portion 410 of the filter body 400 extends between an interior perimeter defining a minimum cross-sectional size and an exterior perimeter defining a maximum cross-sectional size. The second portion 420 is adapted for overlying the annular end surface 35 of the fuel injector inlet tube 3. The third portion 430 is adapted for overlying the outside surface 33 of the fuel injector inlet tube 3. By this arrangement, the filter body 400 directs fuel flow through the flow area of the filter mesh 800. The filter body 400 may be constructed from a variety of materials, including plastics or the like. Preferably, the filter body is constructed of a plastic material. Preferably, the filter body 400 is constructed of 6/6 or 6/12 35% glass filled nylon.

The ferrule 600 includes a first part 610, a second part 620, and a third part 630. The ferrule 600 is adapted to substantially reinforce the filter body 400. The ferrule 600 is adapted to be interposed between the fuel filter body 400 and the fuel injector inlet tube 3. The first part 610 of the ferrule 600 is adapted to contiguously engage the first portion 410 of the filter body 400 and the inside surface 31 of the fuel injector inlet tube 3. The first part 610 of the ferrule 600 defines a mouth having a cross-sectional size that is smaller than the maximum cross-sectional size of the exterior perimeter 413 and is larger than the minimum cross-sectional size of the interior perimeter 411 of the filter body 400. The second part 620 of the ferrule 600 is adapted to contiguously engage the second portion 420 of the filter body 400 and the annular end surface 35 of the fuel injector inlet tube 3. The third part 630 of the ferrule 600 is adapted to contiguously engage the third portion 430 of the filter body 400 and the outside surface 33 of the fuel injector inlet tube 3. The ferrule 600 may be constructed from a variety of materials, including metals such as stainless steel and brass or the like. Preferably, the ferrule 600 is constructed from a metal material, such as brass and/or stainless steel. Preferably, the ferrule 600 is constructed from type 7030 alloy 260 brass. Preferably, the modulus of elasticity of the ferrule 600 is substantially greater than the modulus of elasticity of the filter body 400.

The third portion 430 of the filter body 400 extends above the outside surface 33 of the fuel injector inlet tube 3. Thus, a groove for retaining the O-ring 7 is defined by the third portion 430, the inlet tube 3, and the overmold 5.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A filter unit for an inlet tube of a fuel injector, the inlet tube having an inside surface, an outside surface, and an annular end surface extending between the inside and outside surfaces, the filter unit comprising:

a filter mesh defining a flow area;

a body directing fuel flow through the flow area, the body having a first portion adapted for overlying the inside surface, a second portion adapted for overlying the annular end surface, and a third portion adapted for overlying the outside surface; and a ferrule reinforcing the body, the ferrule having a first part contiguously engaging the first portion of the body, a second part contiguously engaging the second portion of the body, and a third part contiguously engaging the third portion of the body.

2. The filter unit according to claim 1, wherein the ferrule is adapted to be interposed between the body and the inlet tube.

3. The filter unit according to claim 1, wherein the ferrule is adapted to contiguously engage the inside, annular end, and outside surfaces of the inlet tube.

4. The filter unit according to claim 1, wherein first portion of the body extends between an interior perimeter and an exterior perimeter, and wherein the first part of the ferrule defines a mouth having a cross-sectional size that is smaller than a maximum cross-section size defined by the exterior perimeter and larger than a minimum cross-section size defined by the interior perimeter.

5. The filter unit according to claim 1, wherein the body has a greater modulus of elasticity relative to the ferrule.

6. The filter unit according to claim 1, wherein the body is a plastic material and the ferrule is a metal material.

7. The filter unit according to claim 6, wherein the plastic material is nylon, and the metal material is selected from a group consisting of brass and stainless steel.

8. A fuel injector comprising:

an inlet tube having an inside surface, an outside surface, and an annular end surface extending between the inside and outside surfaces;

a filter unit including a filter mesh defining a flow area;

a body directing fuel flow through the flow area, the body having a first portion overlying the inside surface, a second portion overlying the annular end surface, and a third portion overlying the outside surface; and a ferrule reinforcing the body, the ferrule having a first part contiguously engaging the first portion of the body, a second part contiguously engaging the second portion of the body, and a third part contiguously engaging the third portion of the body.

9. The fuel injector according to claim 8, wherein the ferrule is interposed between the body and the inlet tube, and contiguously engages the inside, annular end, and outside surfaces of the inlet tube.

10. The fuel injector according to claim 8, wherein first portion of the body extends between an interior perimeter and an exterior perimeter, and wherein the first part of the ferrule defines a mouth having a cross-sectional size that is smaller than a maximum cross-section size defined by the exterior perimeter and larger than a minimum cross-section size defined by the interior perimeter.

11. The fuel injector according to claim 8, wherein the body has a greater modulus of elasticity relative to the ferrule.

12. The fuel injector according to claim 8, wherein the body is a plastic material and the ferrule is a metal material.

13. The fuel injector according to claim 12, wherein the plastic material is nylon, and the metal material is selected from a group consisting of brass and stainless steel.

14. The fuel injector according to claim 8, further comprising:

an overmold encircling the outside surface; and an O-ring retained in a groove defined by the third portion, the outside surface, and the overmold.

15. A method of manufacturing a filter unit for an inlet tube of a fuel injector, the method comprising:

providing a filter mesh defining a flow area;

providing a ferrule having a first part adapted for overlying the inside surface, a second part adapted for overlying the annular end surface, and a third part adapted for overlying the outside surface; and molding a body to connect the filter mesh and the ferrule, the body directing the fuel flow through the flow area.

16. The method according to claim 15, wherein the providing the ferrule includes forming the first part so as to define a mouth defining a first cross-sectional size, and wherein the molding the body includes forming a first portion having an interior perimeter and an exterior perimeter, the interior perimeter defining a second cross-sectional size smaller than the first cross-sectional size, and the exterior perimeter defining a third cross-section size larger than the first cross-sectional size.

* * * * *